US007040924B2

(12) United States Patent
Droesbeke et al.

(10) Patent No.: US 7,040,924 B2
(45) Date of Patent: May 9, 2006

(54) TERMINAL BLOCK AND CABLE CONNECTOR

(75) Inventors: Gert Droesbeke, Geel (BE); Ivan Joachim Grek, Katrineholm (SE)

(73) Assignee: FCI, Paris (FR)

( * ) Notice: Subject to any disclaimer, the term of this patent is extended or adjusted under 35 U.S.C. 154(b) by 0 days.

(21) Appl. No.: 11/009,205

(22) Filed: Dec. 9, 2004
(Under 37 CFR 1.47)

(65) Prior Publication Data

US 2005/0112941 A1 May 26, 2005

Related U.S. Application Data

(60) Continuation of application No. 10/634,312, filed on Aug. 4, 2003, now Pat. No. 6,851,981, which is a division of application No. 10/157,524, filed on May 28, 2002, now Pat. No. 6,648,688, and a division of application No. 10/160,316, filed on May 30, 2002, now Pat. No. 6,719,587.

(30) Foreign Application Priority Data

May 30, 2001 (NL) ..... 1018175
May 30, 2001 (NL) ..... 1018176

(51) Int. Cl.
*H01R 13/648* (2006.01)

(52) U.S. Cl. ..... 439/608; 439/108

(58) Field of Classification Search ..... 439/608, 439/108, 701, 708–710
See application file for complete search history.

(56) References Cited

U.S. PATENT DOCUMENTS

| | | | | |
|---|---|---|---|---|
| 4,611,867 | A | 9/1986 | Ichimura et al. | 339/14 R |
| 4,846,727 | A | 7/1989 | Glover et al. | 439/608 |
| 5,518,422 | A | 5/1996 | Zell et al. | 439/608 |
| 5,993,259 | A | 11/1999 | Stokoe et al. | 439/608 |
| 6,267,604 | B1 | 7/2001 | Mickievicz et al. | 439/79 |
| 6,299,455 | B1 | 10/2001 | Dong | 439/59 |
| 6,478,624 | B1 | 11/2002 | Ramey et al. | 439/608 |
| 6,520,802 | B1 | 2/2003 | Mitra | 439/608 |
| 6,520,803 | B1 | 2/2003 | Dunn | 439/608 |
| 6,527,588 | B1 | 3/2003 | Paagman | 439/608 |
| 6,540,522 | B1 | 4/2003 | Sipe | 439/61 |
| 6,540,558 | B1 | 4/2003 | Paagman | 439/608 |
| 6,540,559 | B1 * | 4/2003 | Kemmick et al. | 439/608 |
| 6,609,936 | B1 | 8/2003 | Bricaud et al. | 439/630 |
| 6,719,587 | B1 * | 4/2004 | Droesbeke et al. | 439/608 |
| 2003/0022555 | A1 * | 1/2003 | Vicich et al. | 439/608 |

FOREIGN PATENT DOCUMENTS

| | | | |
|---|---|---|---|
| EP | 0446980 | A1 | 9/1991 |
| EP | 0693795 | A1 | 1/1996 |
| EP | 0852414 | A2 | 7/1998 |
| EP | 0939456 | A2 | 9/1999 |
| EP | 0971451 | A2 | 1/2000 |
| EP | 1018785 | A1 | 7/2000 |
| GB | 2027290 | A | 2/1980 |
| WO | WO-01/01527 | | 1/2001 |

* cited by examiner

*Primary Examiner*—Hae Moon Hyeon
(74) *Attorney, Agent, or Firm*—Harrington & Smith,LLP

(57) ABSTRACT

A terminal block for a cable connector comprises a housing of insulating material, a number of signal contacts accommodated in contact cavities of the housing, at least one ground contact arranged between two adjacent signal contacts, and a planar circuit substrate having a ground layer on one side and circuit tracks on the opposite side connected to the signal contacts at one end and having a solder island for connection to a signal wire at the other end. The ground contact comprises a shielding contact blade having a contact lip connected to the ground layer of the circuit substrate and at least one contact lip projecting outwardly to contact the ground layer of a corresponding terminal block.

15 Claims, 10 Drawing Sheets

TERMINAL BLOCK AND CABLE CONNECTOR

CROSS-REFERENCE TO RELATED APPLICATION

This is a continuation patent application of application Ser. No. 10/634,312 filed Aug. 4, 2003, now U.S. Pat. No. 6,851,981, which is a divisional patent application of application Ser. No. 10/157,524 filed May 28, 2002, now U.S. Pat. No. 6,648,688, which is hereby incorporated by reference in its entirety, and a divisional patent application of application Ser. No. 10/160,316 filed May 30, 2002, now U.S. Pat. No. 6,719,587, which is hereby incorporated by reference in its entirety.

BACKGROUND OF THE INVENTION

The invention relates to a terminal block for a cable connector, comprising a housing of insulating material, a number of signal contacts accommodated in contact cavities of the housing, at least one ground contact arranged between two adjacent signal contacts, and a planar circuit substrate having a ground layer on one side and circuit tracks on the opposite side connected to the signal contacts at one end and having a solder island for connection to a signal wire at the other end, and to a cable connector comprising such a terminal block.

EP-A-0 971 451 discloses a terminal block and cable connector of the above-mentioned type. In the known terminal block, a row of five contact cavities is provided in the housing accommodating five contacts. The central contact is used as the ground contact, so that at least one of the contact cavities in the row is used for a ground contact. Further, there are no provisions to connect a ground layer of a terminal block to the ground layer of a next terminal block in one connector having a stack of such terminal blocks.

The invention aims to provide an improved terminal block of the above-mentioned type.

To this end the terminal block according to the invention is characterized in that the ground contact comprises a shielding contact blade having a contact lip connected to the ground layer of the circuit substrate and at least one contact lip projecting outwardly to contact the ground layer of a corresponding terminal block.

In this manner a terminal block is obtained, wherein the ground contact operates as a shielding between adjacent signal contacts and wherein the ground contact further provides an interconnection between two stacked terminal blocks of a cable connector. Moreover, a separate contact cavity in the housing for a ground contact is not required.

The invention further provides a cable connector, comprising a plurality of stacked terminal blocks, wherein the contact lips of the shielding contact blades of one terminal block are contacting the ground layer of the circuit substrate of a next terminal block.

BRIEF DESCRIPTION OF DRAWINGS

The invention will be further explained by reference to the drawings in which an embodiment of the connector assembly of the invention is shown.

FIGS. 1 and 2 show a terminal block 1 for a cable connector, comprising a housing 2 of insulating material. The housing 2 is shown in more detail in FIGS. 4 and 5. The housing 2 comprises a row of contact cavities 3 having an inlet opening 4 for receiving contact pins 5 of a mating connector 6 shown by way of example in FIG. 9. The terminal block of FIGS. 1 and 2 comprises four signal contacts 7 accommodated in the contact cavities 3. A planar circuit substrate 8, more particularly a printed circuit board, has a ground layer 9 on one side and circuit tracks 10 on the opposite side. At one end the circuit tracks 10 have a solder island 11 for connection to the signal contacts 7 and at the other end the circuit tracks 10 have a solder island 12 for connection to a signal wire of a cable not shown.

DETAILED DESCRIPTION OF THE INVENTION

Figure 3:
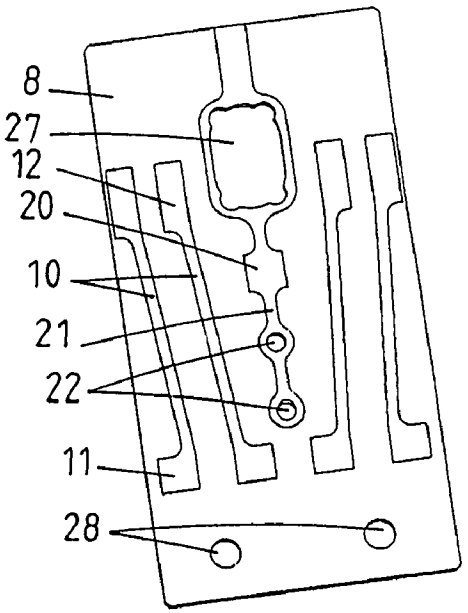
FIG. 3 is a perspective view of the planar circuit substrate of the terminal block of FIGS. 1 and 2.
Figure 2:
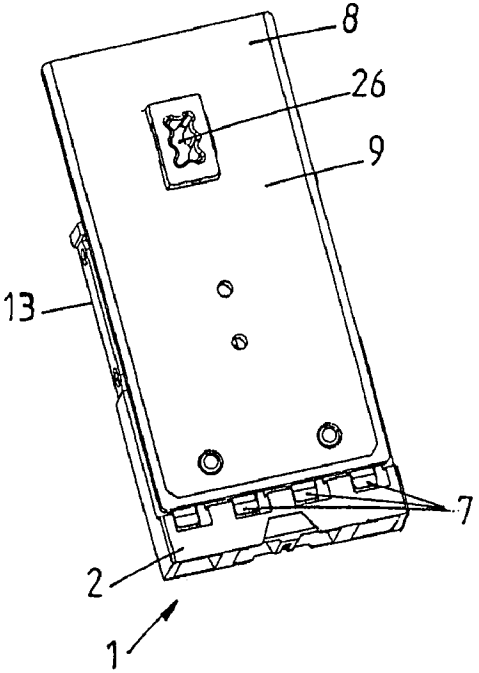
FIGS. 1 and 2 show perspective views of opposite sides of an embodiment of the terminal block of the invention.
Figure 1:
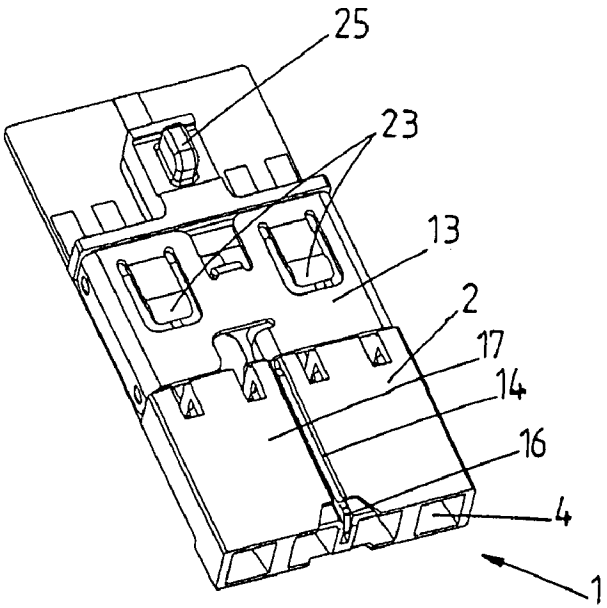
Figure 6:
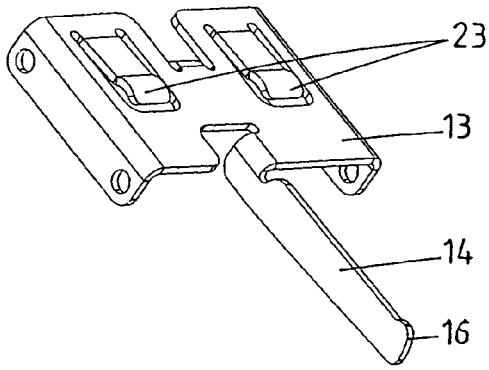
FIGS. 6 and 7 show perspective views of a shielding element of the terminal block of FIGS. 1 and 2.
Figure 7:
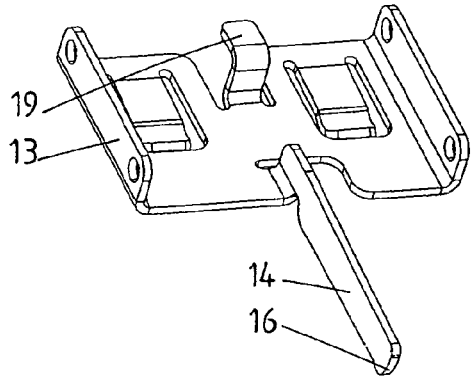
Figure 4:
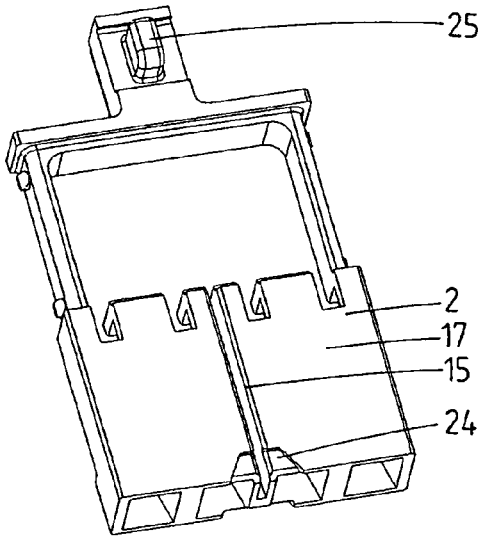
FIGS. 4 and 5 show perspective views of opposite sides of the housing of the terminal block of FIGS. 1 and 2.
Figure 5:
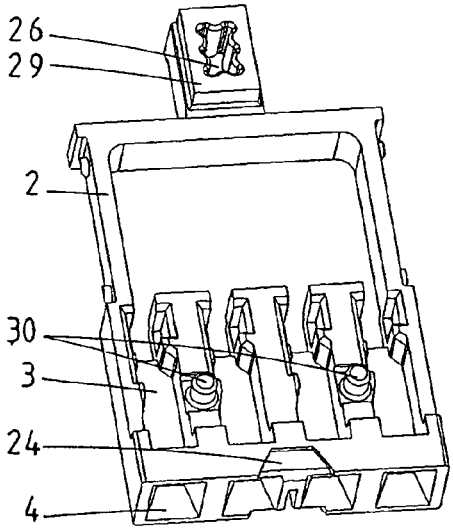
Figure 9:
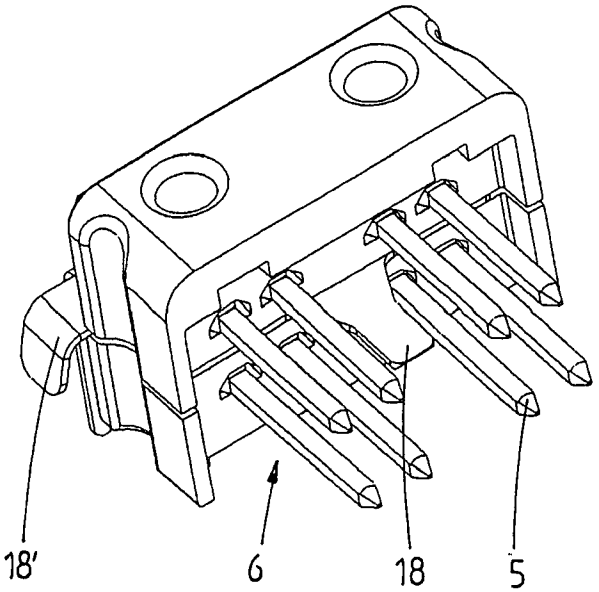
FIG. 9 shows a perspective view of a connector to be mated with a connector having the terminal blocks of FIG. 8.

In the embodiment of FIGS. 1 and 2, the terminal block 1 comprises a shielding element 13 shown in detail in FIGS. 6 and 7. The shielding element 13 comprises a vertical shielding contact blade 14, which is received in a slot 15 of the housing 2. At its free end the contact blade 14 has a contact end 16 projecting out of a main surface 17 of the housing 2 to contact a contact lip 18 of a shielding element 18' of the mating connector 6. The vertical shielding contact blade 14 provides an effective vertical shielding between the adjacent signal contacts 7 of the terminal block 1.

The terminal block 1 shown is intended to be used in a cable connector for twin axial wire pairs. In case of coaxial wires, a vertical shielding blade will be accommodated between each two adjacent signal contacts 7.

The shielding element 13 further comprises a contact lip 19 connected to a solder island 20 of the printed circuit board 8. This solder island 20 is part of a ground circuit track 21 connected by means of at least one plated through-hole 22 to the ground layer 9. In the embodiment shown two plated through-holes 22 are used. Further, the shielding element 13 is provided with two spring-type contact lips 23 projecting outwardly to contact the ground layer 9 of a corresponding terminal block in a cable connector with two or more stacked terminal blocks 1. An example of two stacked terminal blocks 1 is shown in FIG. 8.

Figure 10:
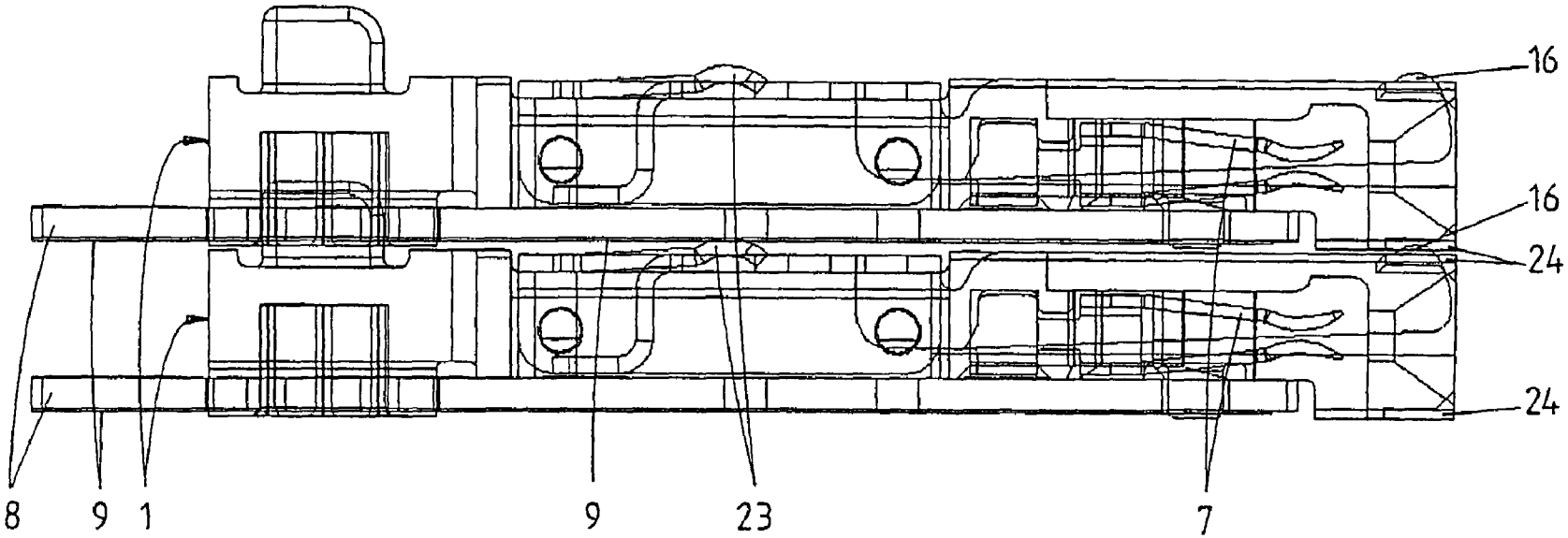
FIG. 10 is a cross-section of the terminal blocks of FIG. 8.

A cross-section of the two stacked terminal blocks 1 is shown in FIG. 10. As can be seen in FIG. 10, the spring-type contact lip 23 of the upper terminal block 1 projects outwardly and the contact lip 23 of the lower terminal block 1 is pressed against the ground layer 9 of the printed circuit board 8 of the upper terminal block 1. Further, FIG. 10 shows that the contact end 16 of the vertical shielding contact blade 14 projects out of the main surface 17 of the housing 2. In order to allow a connection between this contact end 16 and the ground contact lip 18 of the mating connector 6, at least the main surface 17 of the housing 2 is provided with a recess 24 for receiving this contact lip 18. In the embodiment shown the opposite main surface of the housing 2 is also provided with a recess 24 and the two recesses 24 of the stacked terminal blocks 1 provide a cavity for receiving the contact lip 18.

Figure 8:
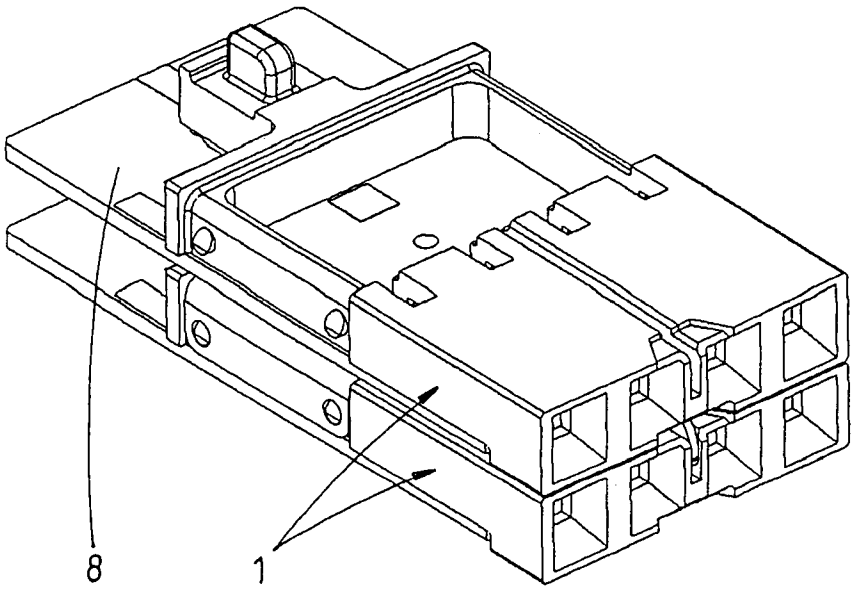
FIG. 8 shows a perspective view of two stacked terminal blocks of FIGS. 1 and 2.

As will be described shortly hereinafter, the stacked terminal blocks 1 as shown in FIG. 8 will be received in an outer housing, preferably also providing an outer shielding, wherein the contact lips 23 of the upper terminal block 1 can contact this outer shielding. The stacked terminal blocks 1 are attached to one another by means of a projection 25 of one terminal block received in a recess 26 of a next terminal block. The printed circuit board 8 is attached to the housing 2 by means of openings 27, 28 receiving a raised part 29 and pegs 30, respectively.

It will be clear that in a cable connector comprising terminal blocks 1 as shown in FIGS. 1, 2 a complete shielding of the signal contacts 7 both in horizontal direction and vertical direction is obtained. Further, the same shielding elements 13 providing the vertical shielding between adjacent signal contacts 7 also provide an interconnection with multiple contact points between the ground layers of stacked terminal blocks 1. Signal density is maximized as no separate contact cavities with ground contacts are needed.

Figure 12:
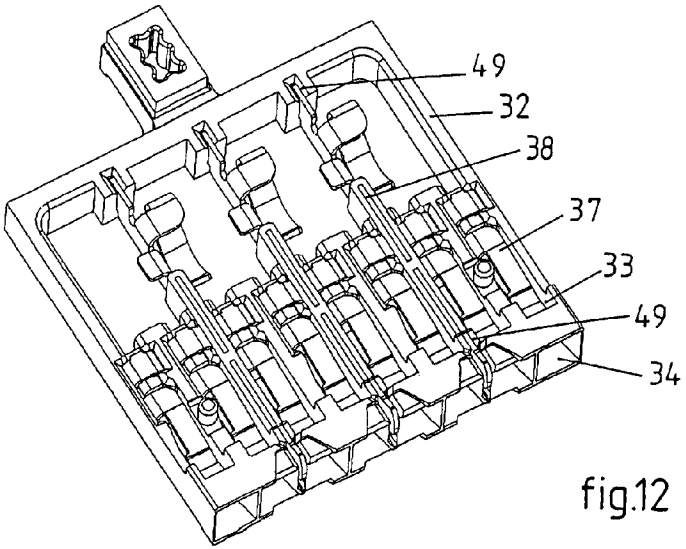
FIGS. 11 and 12 show the housing of a second embodiment of the terminal block according to the invention.
Figure 13:
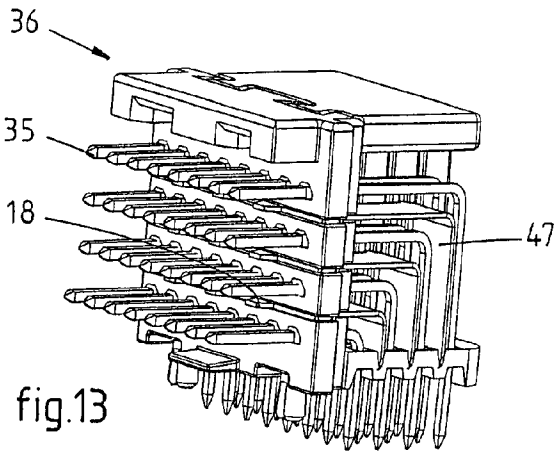
FIG. 13 shows a perspective view of the connector to be mated with a connector comprising four of the terminal blocks having the housing according to FIGS. 11 and 12.
Figure 11:
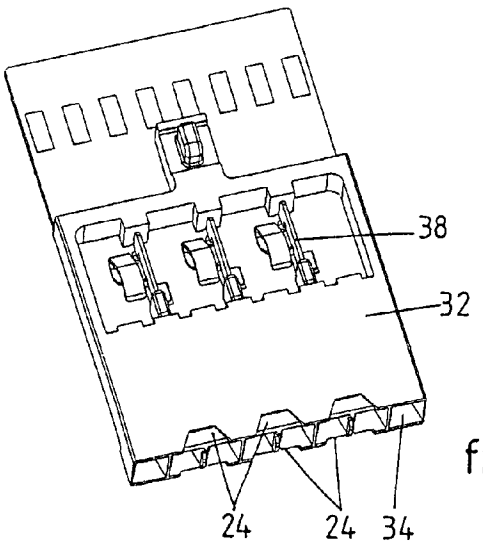
Figure 15:
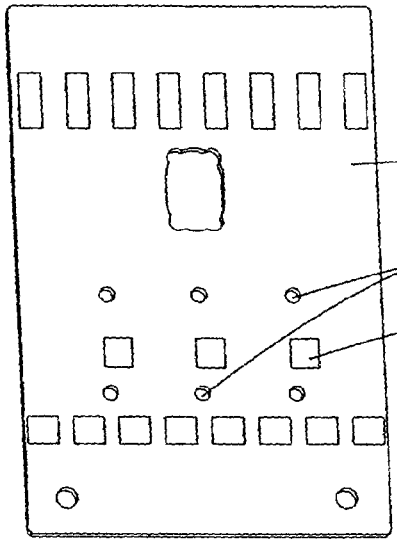
FIG. 15 shows a perspective view of a planar circuit substrate of the terminal block of FIG. 14.
Figure 14:
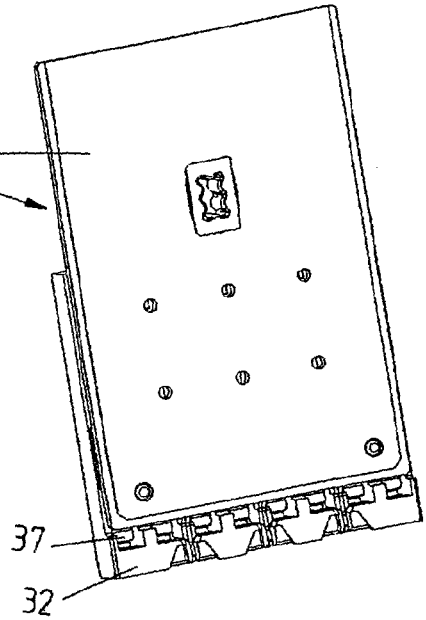
FIG. 14 shows a perspective view of the terminal block having the housing of FIGS. 11 and 12.

A second embodiment of the terminal block of the invention will be explained by reference to FIGS. 11–17. This second embodiment mainly corresponds with the embodiment of FIGS. 1–10. FIG. 14 shows a terminal block 31 comprising a housing 32 of insulating material and a row of eight contact cavities 33 with inlet openings 34 for contact pins 35 of a mating connector 36 shown in FIG. 13. The mating connector 36 is described in more detail in a co-pending patent application of the same applicant entitled "Right-angled connector". Signal contacts 37 are mounted in the contact cavities 33 as shown in FIG. 12. Between each pair of signal contacts 37 a vertical shielding contact blade 38 is arranged. The shielding contact blade 38 is shown in detail in FIGS. 16 and 17. Each shielding contact blade 38 is provided with a contact lip 39 connected to a solder island 40 of a printed circuit board 41. The solder islands 40 are connected by circuit tracks not shown to plated through-holes 43 connecting the ground solder islands 40 to a ground layer 44 on the other side of the printed circuit board 41.

Further, each vertical shielding contact blade 38 is provided with one spring-type contact lip 45 projecting outwardly to contact the ground layer 44 of a corresponding terminal block 31. At one end each shielding contact blade is provided with a contact end 16 also projecting out of a main surface of the housing 32 to contact a contact lip 18 of the mating connector 36. These contact lips 18 of the mating connector 36 are part of right-angled shielding plates 47 as described in the above-mentioned co-pending patent application. Recesses 24 in the main surfaces of the housing 32 provide cavities for receiving the contact lips 18.

Figure 16:
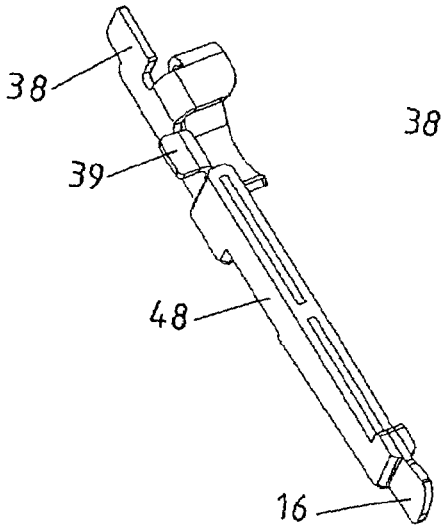
FIGS. 16 and 17 show perspective views of the shielding contact plate of the terminal block of FIG. 14.
Figure 17:
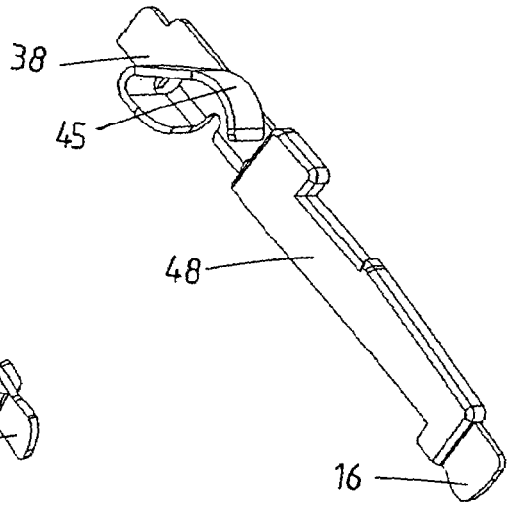

The shielding contact blades 38 are partly over-moulded with insulating material 48 as shown in FIGS. 16, 17. The overmoulded shielding blades are received in slots 49 of the housing 32.

It will be understood that the separate shielding contact blades 38 can be part of a shielding element in the same manner as in the embodiment of FIGS. 1 and 2. In the same manner as in this embodiment of FIGS. 1 and 2, a cable connector with two or more terminal blocks 31 is provided with a complete shielding of the signal contacts 37 both in the horizontal direction and vertical direction. Moreover, the contact blades 38 also provide an interconnection with multiple contact points between the ground layers 44 of stacked terminal blocks 31 in the same manner as shown in FIG. 10 for the terminal block 1. Signal density is maximized as no separate contact cavities with ground contacts are needed.

Figure 19:
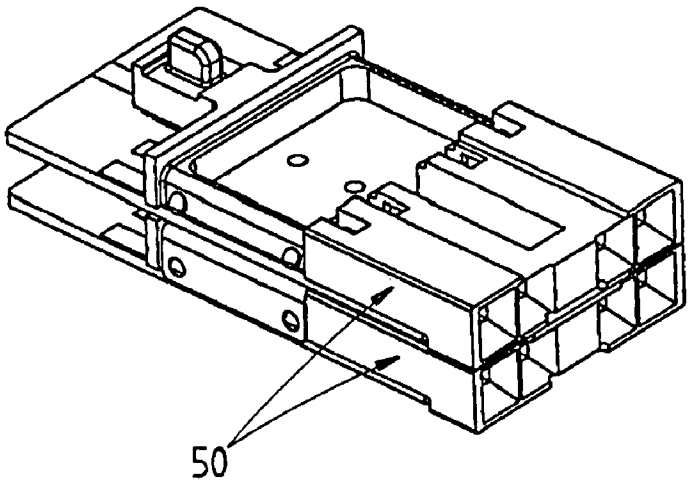
FIG. 19 shows an assembly of two terminal blocks of FIG. 18.
Figure 18:
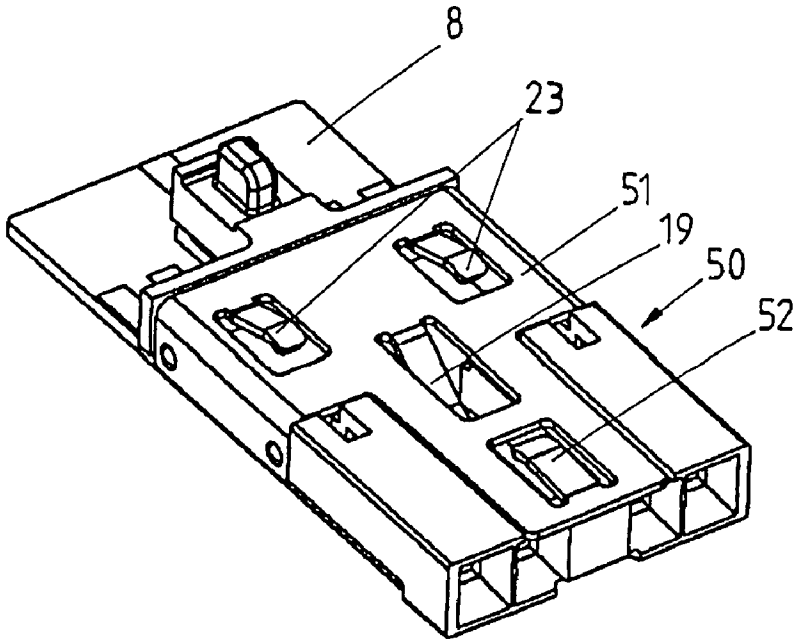
FIG. 18 shows a perspective view of a different embodiment of the terminal block of the invention.

FIGS. 18–26 show some alternative embodiments of the terminal block of the invention, wherein corresponding. parts are indicated by the same reference numerals as in FIGS. 1–10. FIGS. 18 and 19 show a terminal block 50 wherein a shielding element 51 is used having the contact lip 19 connected to the ground layer of the printed circuit board 8 and two spring-type contact lips 23 to contact the ground layer of a further terminal block 50 when two terminal blocks 50 are stacked as shown in FIG. 19. In this embodiment the shielding element 51 is provided with a further contact spring 52 at a front end of the terminal block 50 and this contact spring 52 is adapted to contact a contact lip of a mating connector. In the same manner as in the above-described embodiments, the shielding element 51 provides both for an interconnection of the shieldings of the cable connector having the terminal blocks 50 and a mating connector, and for interconnecting the ground layers of the stacked terminal blocks 50.

Figure 21:
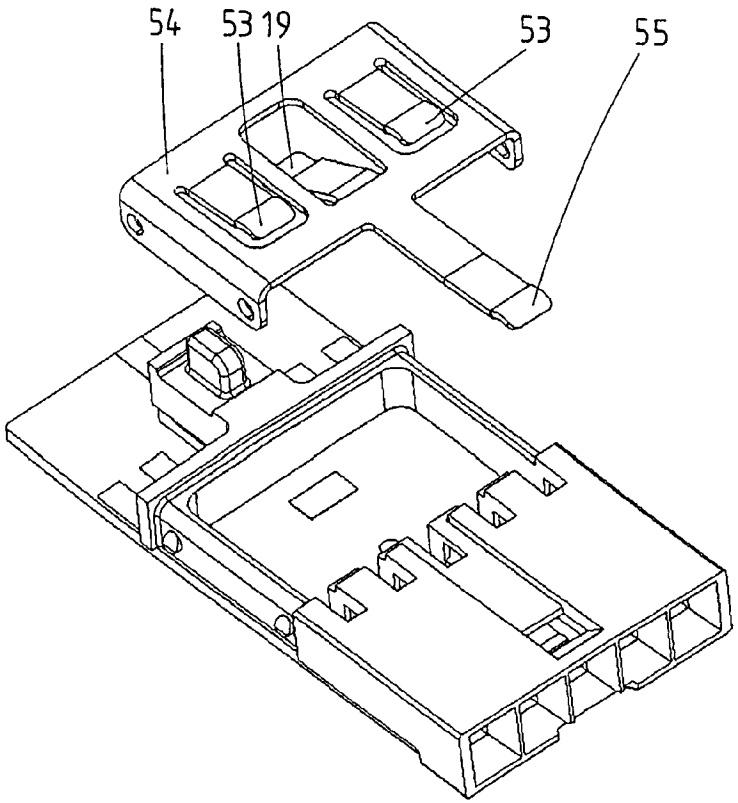
FIGS. 20 and 21 show perspective views of a further embodiment of the terminal block according to the invention.
Figure 20:
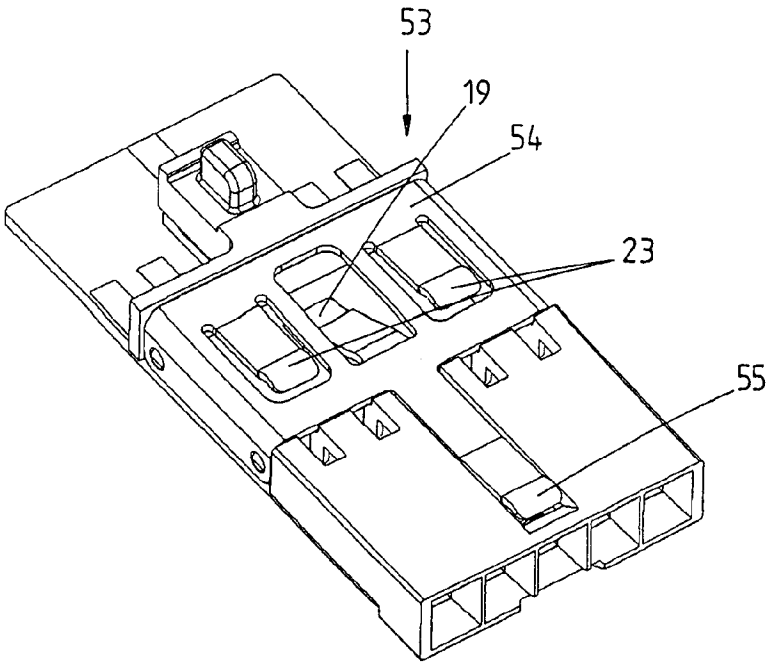
Figure 22:
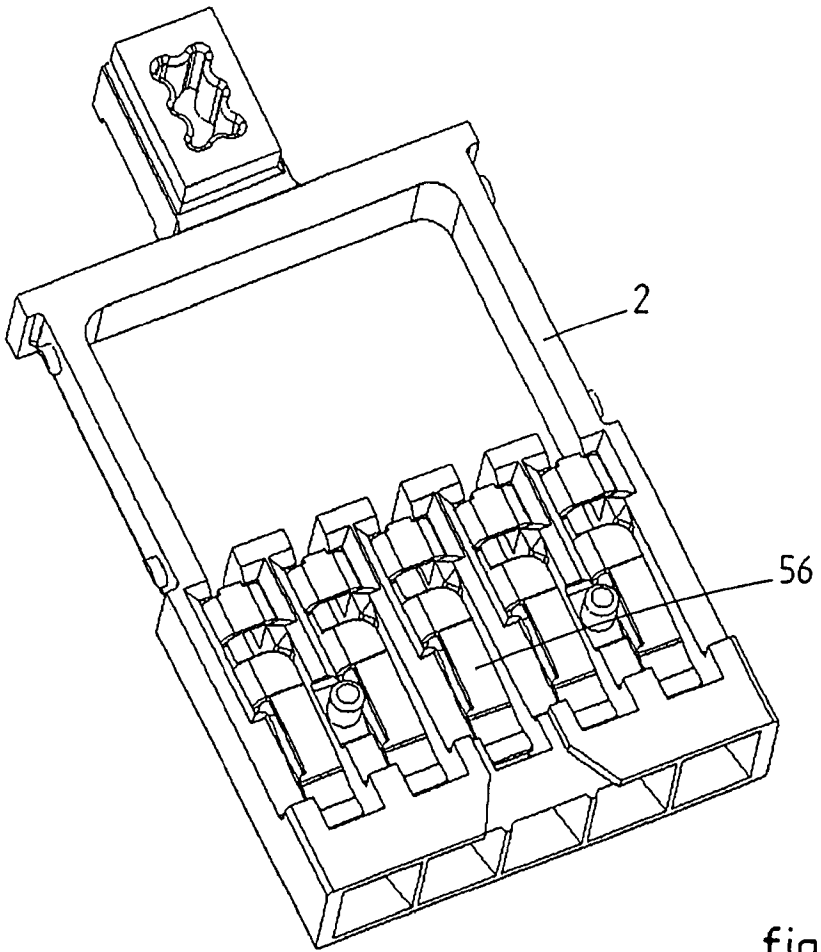
FIG. 22 shows a perspective view of the housing with contacts of the terminal block of FIG. 20.

In FIGS. 20–22 a terminal block 53 is shown having a shielding element 54 mainly made in the same manner as the shielding element 51. The shielding element 54 comprises the contact lip 19 connected to the ground layer of the printed circuit board 8 and the spring-type contact lips 23 for contacting the ground layer of a further terminal block 53. Further, the shielding element 54 is provided with a contact spring 55 for contacting a contact lip of a mating connector. In this embodiment the housing 2 is provided with a fifth central contact cavity accommodating a central contact 56. This central contact 56 can be used as further ground contact for contacting a ground contact of a mating connector.

Figure 24:
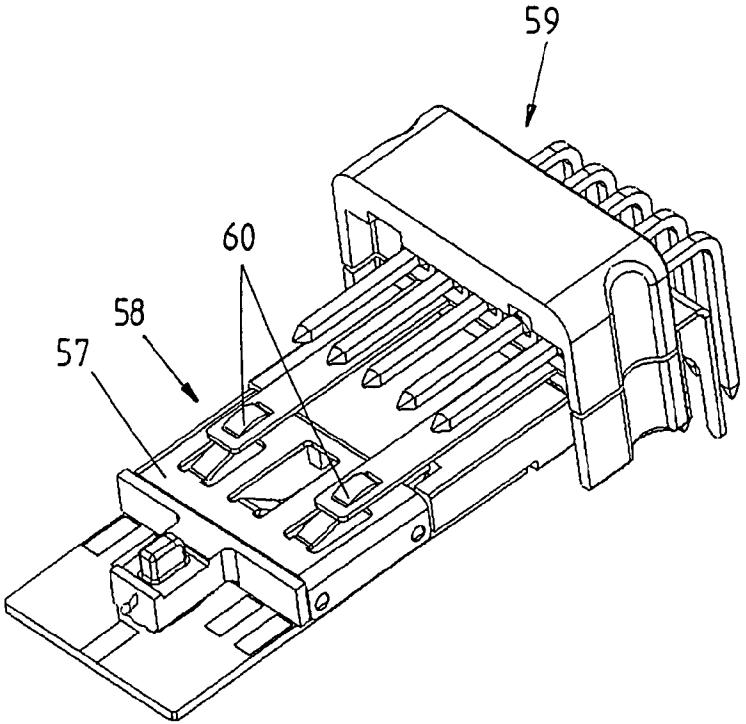
FIGS. 24 and 25 show a connector assembly, comprising a cable connector with a terminal block having the shielding element of FIG. 24.
Figure 23:
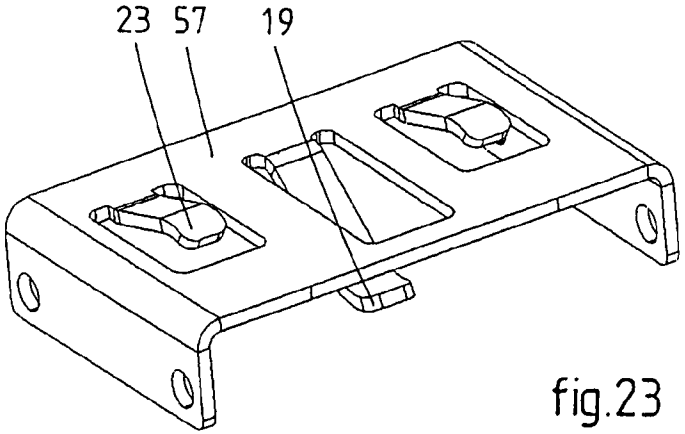
FIG. 23 shows an alternative embodiment of the shielding element of a terminal block according to the invention.

FIG. 23 shows a further embodiment of a shielding element 57 mainly made in the same manner as the shielding element 51, wherein the contact spring 52 is omitted. A terminal block 58 mainly made in the same manner as the terminal block 53, is provided with the shielding element 57 and with a printed circuit board 8. A mating connector 59 is provided with two extended contact lips 60 contacting the spring-type contact lips 23 of the shielding element 57. The shielding element 57 also has a contact lip 19 connected to the ground layer of the printed circuit board 8. In the mated position as schematically shown in FIG. 24, the extended contact lips 60 are connected to the spring-type contact lips 23 of the shielding element 57 and these extended contact lips 60 are further connected to the ground layer of the printed circuit board 8 of a next terminal block 58 not shown in FIG. 24.

Figure 25:
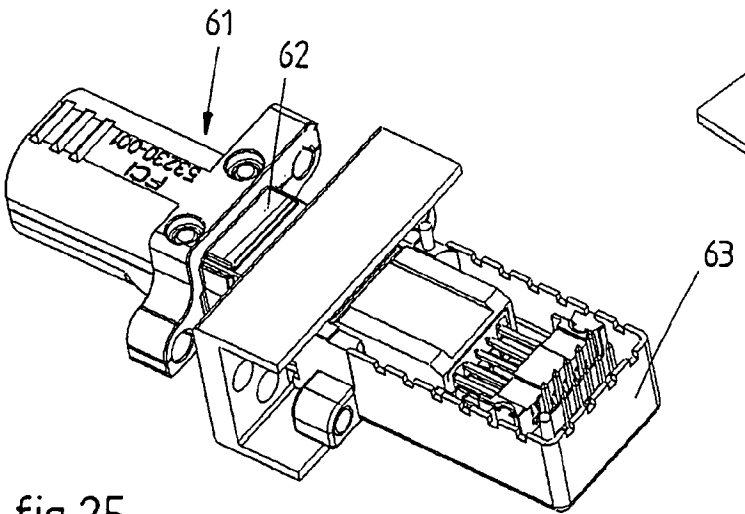

FIG. 25 shows a perspective view of a partially mated connector assembly showing a cable connector 61 having two terminal blocks 58 mounted in an outer housing 62. The mating connector 59 is received in a housing 63, which can be mounted on a printed circuit board not shown.

The invention is not restricted to the above-described embodiments, which can be varied in a number of ways within the scope of the attached claims.

What is claimed is:

1. A terminal assembly comprising:

a housing having contact receiving cavities;

a circuit substrate having a first side with a ground area and a second side with circuit tracks;

signal contacts, at least partially located in the contact receiving cavities, connected to the circuit tracks on the second side of the circuit substrate; and a ground contact located proximate the second side of the circuit substrate and electrically coupled to the ground area on the first side of the circuit substrate.

2. The terminal assembly as in claim 1 further comprising a shielding section extending across a width of the housing.

3. The terminal assembly as in claim 2 wherein the shielding section extends along portions of exterior lateral sides of the housing.

4. An electrical cable connector having a plurality of contacts arranged in rows and columns comprising:

a first terminal block comprising the terminal assembly as in claim 1; and a second terminal block comprising another one of the terminal assembly as in claim 1, wherein the second terminal block is connected to the first terminal block in a general stacked configuration.

5. An electrical connector assembly comprising:

the electrical cable connector as in claim 4; and a mating electrical connector connected to the electrical cable connector, wherein the mating electrical connector comprises a plurality of contact elements arranged in rows and columns, and at least one first shielding plate arranged between two adjacent rows of the contact elements.

6. The electrical connector assembly as in claim 5 wherein the mating electrical connector comprises a second shielding plate, wherein the first shielding plate and the second shielding plate are provided with slots receiving the second and first shielding plates, respectively, wherein contact parts are provided for interconnecting the first and second shielding plates, and wherein a plurality of the ground contacts contact a contact lip of one of the shielding plates.

7. A terminal block comprising:

the terminal assembly as in claim 1; and a housing, wherein the housing comprises a first side mounted on the second side of the circuit substrate, wherein the signal contacts and the ground contact are mounted in the housing, and wherein the ground contact comprises a portion which extends out of the first side of the housing and through an aperture in the circuit substrate.

8. A terminal block comprising:

a housing;

a circuit substrate connected to the housing, the circuit substrate having a first side with a ground area and a second side with circuit tracks;

signal contacts on the second side of the circuit substrate connected to the circuit tracks; and a ground contact connected to the housing proximate the second side of the circuit substrate, wherein the ground contact is electrically coupled to the ground area on the first side of the circuit substrate, wherein the ground contact comprises a shielding contact blade between a pair of the signal contacts.

9. The terminal block as in claim 8 wherein a front end of the contact blade forms a contact end adapted for making an electrical connection with a ground contact of a mating electrical connector.

10. The terminal block as in claim 8 wherein the ground contact comprises insulating material overmolded onto the shielding contact blade.

11. A terminal block comprising:

a housing;

a circuit substrate connected to the housing, the circuit substrate having a first side with a ground area and a second side with circuit tracks;

signal contacts connected to the circuit tracks at the second side of the circuit substrate; and a ground contact connected to the housing proximate the second side of the circuit substrate, wherein the ground contact is electrically coupled to the ground area at the first side of the circuit substrate, wherein the ground contact comprises a circuit substrate contact lip connected to a solder island on the second side of the circuit substrate.

12. A terminal block comprising:

a housing;

a circuit substrate connected to a first side of the housing, the circuit substrate comprising a ground layer with at least one contact area on a first outwardly facing side of the circuit substrate and circuit tracks with a plurality of solder islands on an opposite second side of the circuit substrate;

signal contacts located in the housing and connected to the solder islands; and at least one ground contact having at least a portion located inside the housing and located against the second side of the circuit substrate, the at least one ground contact being electrically coupled to the ground layer of the circuit substrate at the first side of the circuit substrate.

13. The terminal block as in claim 12 wherein the ground contact comprises a vertical shielding contact blade with a contact end.

14. The terminal block as in claim 12 further comprising a shielding section extending across a width of the housing.

15. The terminal block as in claim 14 wherein the shielding section extends along portions of exterior lateral sides of the housing.

* * * * *